United States Patent [19]

Morgan

[11] 4,034,594

[45] July 12, 1977

[54] VARIABLE IMPACT TOOL

[75] Inventor: Carl E. Morgan, Petaluma, Calif.

[73] Assignee: Morgan Manufacturing Inc., Petaluma, Calif.

[21] Appl. No.: 731,706

[22] Filed: Oct. 12, 1976

[51] Int. Cl.[2] ..... B21J 13/08

[52] U.S. Cl. ..... 72/457; 81/52.35; 29/255; 29/275; 72/705

[58] Field of Search ..... 81/52.35; 29/254, 255, 29/275; 72/457, 705

[56] References Cited

U.S. PATENT DOCUMENTS

| | | | |
|---|---|---|---|
| 1,597,159 | 8/1926 | Johnson et al. | 29/254 |
| 2,791,926 | 5/1957 | Guyton | 81/52.35 |
| 2,934,984 | 5/1960 | Woodman | 81/52.35 |
| 3,750,500 | 8/1973 | Peterson | 29/255 |
| 3,875,644 | 4/1975 | Simpson | 29/254 |

*Primary Examiner*—James L. Jones, Jr.
*Attorney, Agent, or Firm*—Melvin R. Stidham

[57] ABSTRACT

A variable impact jarring tool comprising a handled shaft with a massive impact sleeve slideable thereon. A self-tapping screw on the end of the shaft is driven to grip the workpiece and a first collar adjacent the handle serves as an anvil against which the sleeve impacts. A second collar may be fixed on the shaft in either of two positions, one adjacent the end for a full impact stroke and the other midway thereof for a limited stroke, but providing more clearance at the end for placement of the screw in close places.

5 Claims, 5 Drawing Figures

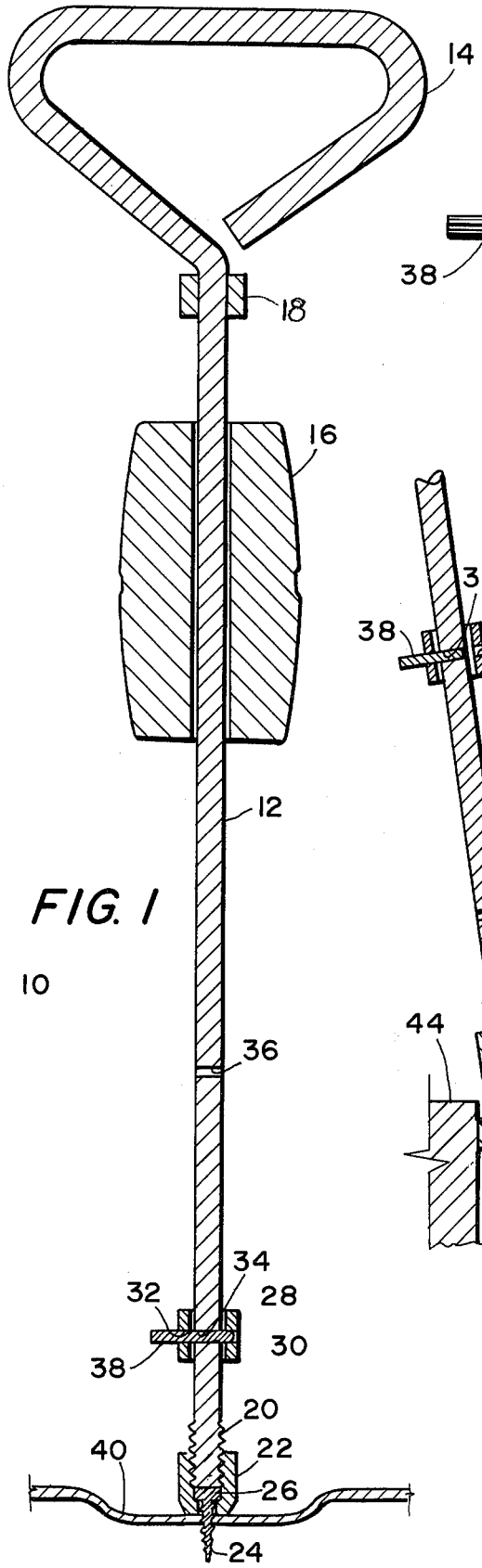
FIG. 1
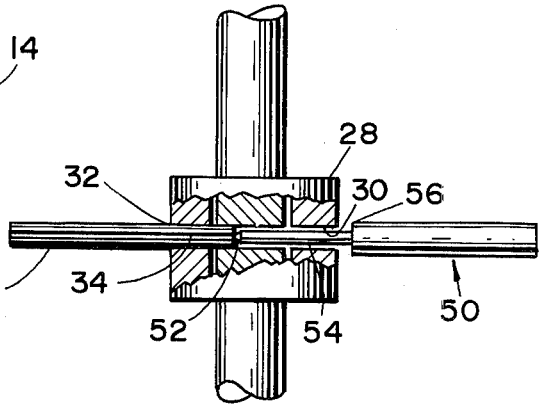
FIG. 3
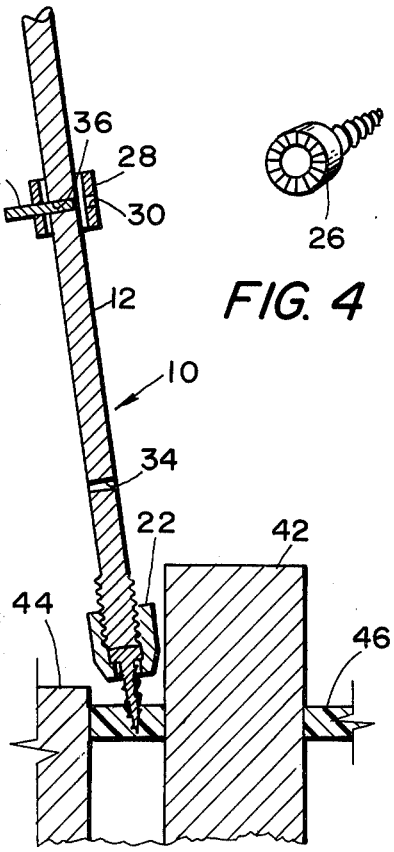
FIG. 2
FIG. 4
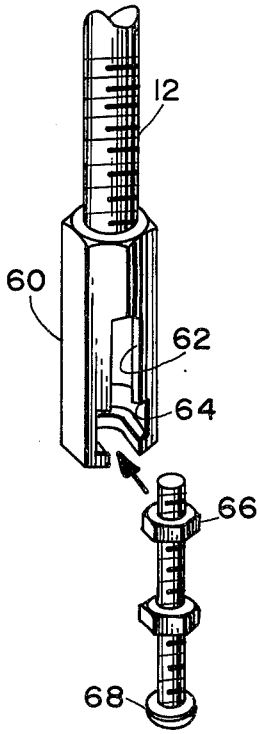
FIG. 5

VARIABLE IMPACT TOOL

BACKGROUND OF THE INVENTION

There is a need for a tool capable of delivering either a substantial jarring action, as in puling out dented metal work, or a lighter tapping action, as in retrieving seals from around shafts or the like.

OBJECTS OF THE INVENTION

It is an object of this invention to provide a variable impact tool to deliver selectively either heavy or relatively light jarring actions.

It is a further object of this invention to provide a jarring tool wherein the stroke of the hammer may be selectively varied.

Other objects and advantages of this invention will become apparent from the descpiption to follow, particularly when read in conjunction with the accompanying drawing.

BRIEF SUMMARY OF THE INVENTION

In carrying out this invention, there is provided an elongated, lightweight shaft which is bent at one end to form a handle. A massive impact sleeve is slideably carried on the shaft to impact against an anvil collar fixed thereon adjacent the handle. A self-tapping screw is carried on the distal end of the shaft, whereby it may be first driven by tapping the impact sleeve, and then turned to engage and grip a workpiece. A second collar carried on the shaft may be fixed in either of two positions thereon. One position, adjacent the end of the shaft, enables a full stroke of the impact sleeve as required for pulling out dented automobile bodies or the like, and the other position, spaced from the end of the shaft, provides greater clearance to insert the end of the tool into narrow places such as around the shaft of an automobile transmission enabling the screw to be secured to shaft seals or the like. In addition, with the collar in the second position, the stroke of the impact sleeve is limited whereby a light tapping force is transmitted as required to pull the seal from around the shaft without tearing it apart.

BRIEF DESCRIPTION OF THE DRAWINGS

In the drawings:

FIG. 1 is a section view of the variable impact jarring tool embodying features of this invention;

FIG. 2 is a partial section view showing the tool in another working configuration;

FIG. 3 is an enlarged partial section view showing a collar attaching means forming a part of this invention:

FIG. 4 is a view in perspective of a self-tapping screw forming a part of this invention; and FIG. 5 shows another form of workpiece gripping means.

DESCRIPTION OF PREFERRED EMBODIMENTS

THe Embodiments of FIGS. 1 to 3

Referring now to the drawings with greater particularity, the impact tool 10 of this invention comprises a lightweight rod or shaft of steel or the like having a high strength to weight ratio. One end of the shaft 14 is bent, as shown, to form a handle for convenient gripping by the user. Slideably carried on the shaft 12 is a massive, impact-delivering sleeve 16 of cast steel or the like which may be grasped by the operator's other hand while gripping the handle 14 to deliver an impact against an anvil collar 18, which is fixed on the shaft adjacent to the handle. Maximum efficiency is achieved by reason of the heavy hammer 16 and the light object, being driven thereby i.e. the shaft 12.

Threaded onto the distal end of the shaft at 20 is a holder 22 which grips a self-tapping screw 24 therein. The screw head 26 may be knurled or serrated, as shown in FIG. 4, to be frictionally gripped by the end of the shaft 12, whereby the screw 24 will turn with the shaft 12.

Also slideably received on the shaft 12 is an adjustable collar 28 having aligned radial holes 30 and 32 which are adapted to be aligned with either one of two spaced radial holes 34 and 36 through the shaft 12. Tightly received in the aligned holes is a holding pin such as a rolled spring pin 38. Hence, the collar 28 may be moved to either of two selected positions and the pin 38 driven to lock it firmly in place.

In the position shown in FIG. 1, with the collar adjacent to the head 22 the massive weight 16 is able to make a full stroke over almost the full length of shaft 12, for maximum impact. Hence, the screw 24 may be tapped to engage a dent 40 in an automobile body or the like and the handle 14 turned to fix the self-tapping screw 24 firmly in place. Then, a series of impacts may be delivered by the weight 16, through the full stroke enabled by the extreme position of the collar 28, against the anvil collar 18 to pull the dent out.

In the position shown in FIG. 2 with the pin locking the collar in the position determined by the hole 36, in the mid-portion of the shaft 12, the end of the shaft immediately above the head 22 is free of any obstruction to enable placement of the tool in rather narrow places such as might exist around the shaft 42 of an automobile transmission 44 or the like, in order to grip a shaft seal for replacement thereof. Again, as in the first embodiment, the screw is tapped 24 into the seal 46 around the shaft 42, and the handle 14 is turned to imbed the screw firmly. Then a series of relatively light tapping blows against the anvil with strokes of the hammer 16 being limited by the shorter space above the raised collar 28, will pull the seal 46 free from the housing 44 around the shaft 42.

Referring now to FIG. 3, there is shown a pin punch 50 which may be used to move the adjustable collar 28 from a previously selected position. In operation, the point 52 of the punch is received in the rolled spring pin 38 and the portion 54 is of a diameter to fit in the aligned holes 30, 32 and 34. A shoulder 56 on the punch limits the extent to which the punch may penetrate the aligned holes so that the pin is driven from the hole 34 of the shaft, but not completely free from the aligned hole 32 in the collar 28. Then, the collar may simply be moved to the other aligned hole 36 and driven in to lock the collar 28 in place.

The Embodiment of FIG. 5

Referring now to FIG. 5, there is shown another embodiment of the workpiece gripper, which comprises a threaded sleeve 60 having a lengthwise slot 62 therein of a width to receive a threaded rod 64 such as a standard bolt. A transverse slot 64 intersects the lengthwise slot 62 to receive an enlargement on the screw, such as a nut threaded thereon or even the head 68 thereof. Hence, when it is desired to deliver an impact to some member having a screw or stud secured therein, it is merely necessary to select sleeve 60 of proper size, thread a nut onto the stud and apply the impact as in FIG. 1. In addition there are instances wherein a hole in sheet metal to be straightened would not cause irreparable harm. Accordingly, the operator may insert a bolt 64 in such hole, attach a nut 66 and grip it as described. With the ball 64 received in the longitudinal slot 62 it is disposed coaxially with the hexagonal member 60 and, hence, with the shaft 12. Hence a blow imparted by the hammer 16 is delivered directly along the axis of the bolt 64.

WHile this invention has been described in conjunction with preferred embodiments thereof, it is obvious that modifications and changes therein may be made by those skilled in the art without departing from the spirit and scope of this invention, as defined by the claims appended hereto.

What is claimed as invention is:

1. A variable impact jar-transmitting tool comprising;
a shaft;
a handle on one end of said shaft;
an anvil on said shaft adjacent said handle;
a massive impact sleeve slideable on said shaft and adapted to be gripped manually;
means on the other end of said shaft for gripping a workpiece;
a collar slideable on said shaft intermediate said other end and said sleeve; and
interengagable means on said collar and said shaft for locking said collar selectively in a first position adjacent said workpiece gripping means to enable maximum stroke of said impact sleeve and a second position displaced therefrom to limit said stroke and to provide substantial clearance between said collar and said gripping means.

2. The tool defined by claim 1 wherein said workpiece gripping means comprises;
a screw member having a pointed end adapted to penetrate a workpiece under impact of said impact sleeve against said collar.

3. The tool defined by claim 1 wherein said workiece gripping means comprises;
a sleeve threadedly received on the end of said shaft, a lengthwise slot through one side of said sleeve adopted to receive an externally threaded rod; and
a transverse slot intersecting said lengthwise slot and adapted to receive a member on said threaded rod.

4. The tool defined by claim 1 wherein said interchangeable means comprises;
aligned first axial holes through said collar and a pair of spaced second axial holes through said shaft adapted to be aligned selectively with said first axial holes; and
a pin carried in a first axial hole and receivable in a selected one of said second axial holes;
and including;
a pusher member with a penetrating portion thereof of a diameter to be received in said axial holes;
said penetrating portion being long enough to extend through a first axial hole on one side of said collar and the selected second axial hole, but not long enough to push said pin from the opposite, aligned first axial hole.

5. The tool defined by claim 2 wherein said workpiece gripping means comprises:
a screw member having a pointed end adapted to penetrate a workpiece under impact of said impact sleeve against said collar;
a holder threaded onto the end of said shaft; and
a coaxial hole in said holder through which said screw member extends;
the head of said screw member being roughened to be frictionally gripped by the end of said shaft.

* * * * *